United States Patent [19]

Porritt

[11] 4,342,243

[45] Aug. 3, 1982

[54] CHAIN SAW STAND

[76] Inventor: Kendall Porritt, 12918 64th St., SE., Alto, Mich. 49302

[21] Appl. No.: 213,383

[22] Filed: Dec. 5, 1980

[51] Int. Cl.[3] ..... B27B 17/02; B27G 19/00

[52] U.S. Cl. ..... 83/574; 83/788; 83/440.2; 83/856; 83/860; 83/701

[58] Field of Search ..... 83/574, 788, 794, 796, 83/856, 860, 440.2, 701; 269/296

[56] References Cited

U.S. PATENT DOCUMENTS

| | | | |
|---|---|---|---|
| 3,128,802 | 4/1964 | Hostetter | 83/574 |
| 3,808,684 | 5/1974 | Ludwig | 83/788 X |
| 4,210,049 | 7/1980 | Gauthier | 83/788 X |
| 4,248,412 | 3/1981 | DeRoy | 269/296 |

*Primary Examiner*—Donald R. Schran
*Attorney, Agent, or Firm*—Waters, Lesniak & Willey

[57] ABSTRACT

A chain saw stand with means to anchor a chain saw on a top surface thereof with the chain saw blade extending in front of the stand. A pair of pivotally mounted levers are provided which are connected by resilient connecting means. The top lever is disposed generally parallel with and slightly above the chain saw blade and is actuated by the log to be cut by the chain saw. Upon pressure from the log on the top lever, a second lever is pivoted to actuate the chain saw throttle trigger. The resilient connection between the levers permits the lever actuated by the log to continue pivoting until the cutting operation is complete.

5 Claims, 4 Drawing Figures

CHAIN SAW STAND

BACKGROUND OF THE INVENTION

1. Field of the Invention

The present invention relates to saw stands, and, more particularly, to a stand for a chain saw.

2. Description of the Prior Art

The use of chain saws has increased substantially in recent years. While once reserved for the professional wood cutter or the home owner in a distant rural setting, it is now fast becoming a staple in the garages of many suburbanites. While the portability of the chain saw has rendered it ideally suitable for cutting branches off of trees, cutting trees down and cutting logs in random isolated spots throughout a wooded area, it is not ideally suited to cutting a large amount of wood in a single location. In this instance, the user must set the chain saw down, position the log to be cut, and then pick up the chain saw and perform the cutting operation. For the next log or the next cut, the procedure is repeated. Because of this inefficient manner of cutting large amounts of wood, some attempts have been made to design chain saw stands so that a single work station could be set up and the picking up and setting down of the chain saw could be eliminated. However, heretofore, these stands have required at least one hand to be used to operate the chain saw since the proposed designs have movably mounted the chain saw to the stand. While this type of stand provides some improvement in the efficiency of wood cutting, it is still less than desirable.

The ideal chain saw stand would be one which would leave the user's hands completely free to handle the logs to be cut and which is simple in construction and easy to use.

SUMMARY OF THE INVENTION

According to the present invention, a chain saw stand is provided which is simple, economical and easy to use and which does not require the operator to handle the chain saw thereby leaving his hands free to handle the logs to be cut.

The unique chain saw stand comprises a stand having a top surface with means to anchor a chain saw on the top surface with the chain saw blade extending in front of the stand. A top lever is pivotally mounted to the stand about the top surface so as to be adjacent to and generally parallel with the chain saw blade and slightly above it. A throttle lever is pivotably mounted on the stand surface and is positioned to engage the throttle trigger of the chain saw when it is anchored to the top surface of the stand.

A resilient connecting means, preferably a rubber band, is provided between the end of the top lever remote from the blade and the end of the throttle lever nearest the trigger so that when a log is brought into contact with the blade, the log causes the top lever to pivot downwardly which causes the throttle lever to pivot upwardly via the connecting means to actuate the chain saw trigger to accelerate the engine of the saw for cutting the log. Since the log maintains contact with the top lever as it progresses downwardly through the cutting operation, the resilient connecting means permits this extended pivoting of the top lever beyond the point where the throttle lever has fully depressed the chain saw trigger.

In a preferred embodiment, a rigid vertical stop member is provided adjacent to the end of the chain saw blade to prevent the log to be cut from thrusting forwardly during the cutting operation. In addition, for safety purposes, a guard is provided at the end of the chain saw blade.

DESCRIPTION OF THE PREFERRED EMBODIMENT

Figure 1:
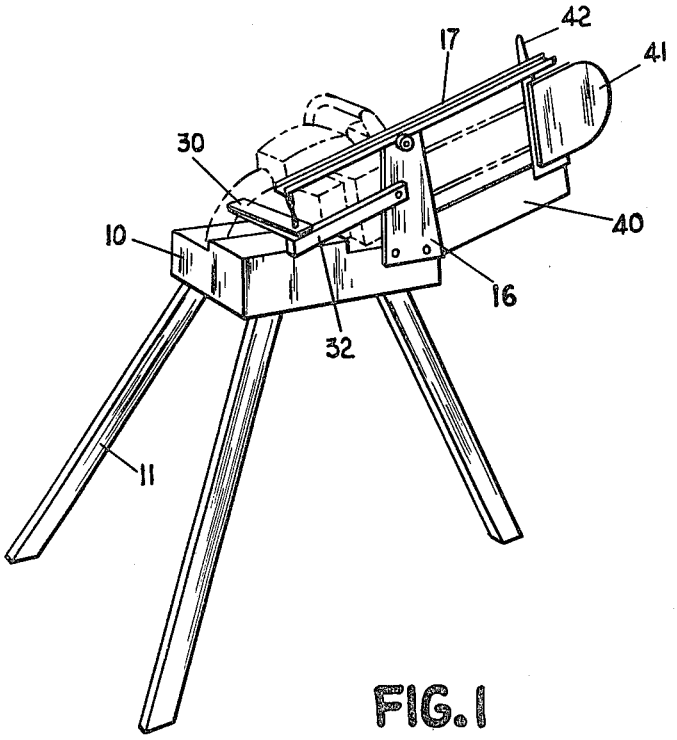
FIG. 1 is a perspective view of the chain saw stand of the present invention with a chain saw shown in phantom.

Referring to the drawings in greater detail, FIG. 1 shows the chain saw stand of the present invention including stand top 10 and legs 11. The tripod arrangement of the legs is preferred for stability when using the stand in rough terrain.

Figure 2:
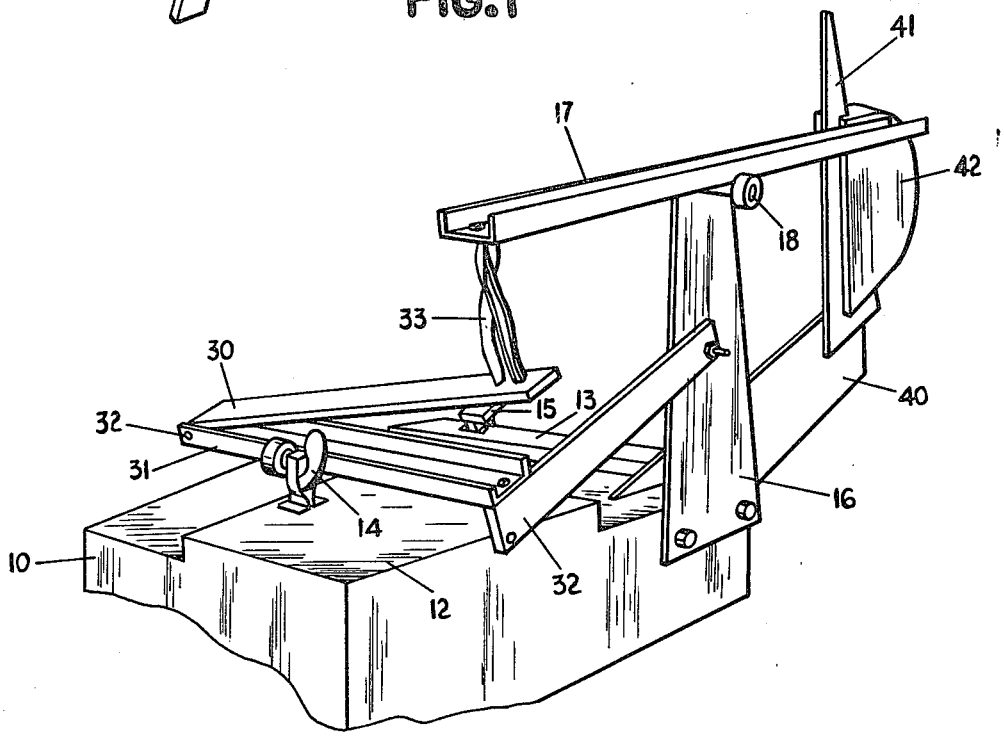
FIG. 2 is an enlarged perspective view of the top of the chain saw stand.
Figure 3:
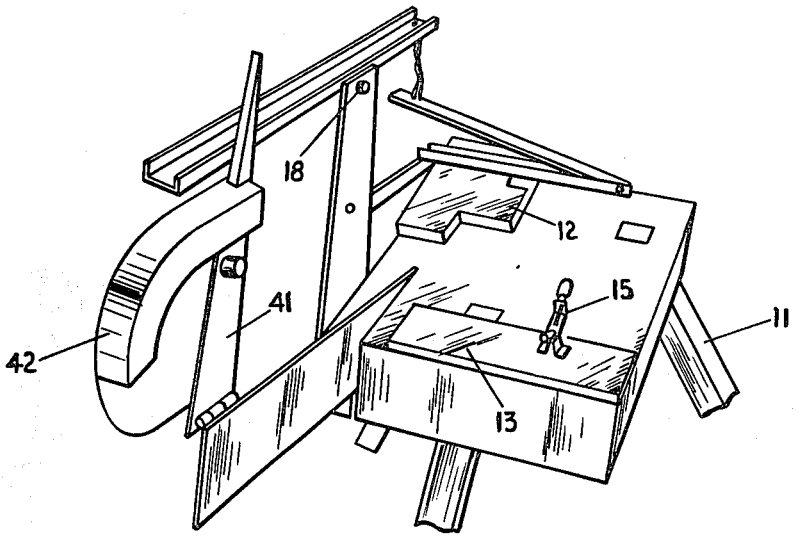
FIG. 3 is a top perspective view of the chain saw stand.
Figure 4:
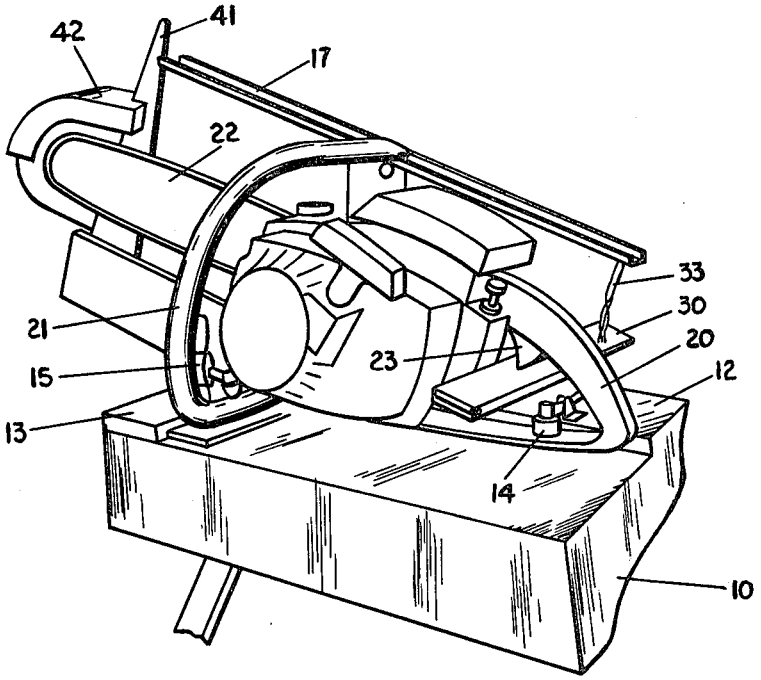
FIG. 4 is a rear perspective view of the top of a chain saw stand with a chain saw in place.

The details of the stand top are most clearly shown in FIGS. 2 and 3. Stand top 10 has two raised clamp-mounting portions 12 and 13. Clamp 14 is provided on portion 12 to clamp the handle 20 of the chain saw as shown in FIG. 4. Clamp 15 is provided on portion 13 to clamp hand grip 21 of the chain saw, also as shown in FIG. 4. By the use of the clamps 14 and 15, the chain saw is rigidly anchored to the chain saw stand.

On the side of the chain saw stand top generally vertical upright fulcrum member 16 is provided. At the top of member 16, top lever 17 is pivotably mounted on pivot shaft 18. With the chain saw in place as shown in FIG. 4, lever 17 is generally parallel with and slightly above chain saw blade 22. Throttle lever 30 is pivotably mounted on the stand top so as to engage trigger 23 of the chain saw as shown in FIG. 4. In the embodiment shown, lever 30 is mounted to support channel 31 by a pivot pin 32. Channel 31 is in turn rigidly mounted to support brace 32 which is mounted to stand top 10 and to member 16 to provide a rigid structure. The free end of lever 30 is connected to the nearest end of lever 17 by a resilient connecting means 33. Although a variety of resilient means can be employed, a heavy-duty rubber-band is preferred.

In the preferred embodiment, a rigid extension 40 is provided which extends in front of the chain saw stand and below and parallel with the chain saw blade. At the end of extension 40 is mounted a vertical log stop 41 and a blade guard 42.

In use, the chain saw is rigidly anchored to the chain saw stand as shown in FIG. 4 with throttle lever 30 engaging the chain saw throttle trigger 23. In cutting a log, the operator brings the log in contact with top lever 17 and moves the log downwardly above the chain saw blade. As the free end of top lever 17 pivots downwardly, the opposite end pivots upwardly which raises the free end of lever 30 via connecting means 33. As the free end of lever 30 is moved upwardly, chain saw throttle trigger 23 is depressed to accelerate the chain saw. The log is then moved downwardly during the cutting operation continuing to pivot the free end of lever 17 downwardly. Because the extent of pivoting of lever 17 is greater than the extent of pivoting of lever 30, the resilience is necessary in connecting means 33 so that the pivoting of lever 17 can continue after throttle trigger 23 is fully compressed. When the cutting operation is complete, the tension on connecting means 33 will decrease allowing the free end of lever 30 to drop downwardly thereby decelerating the chain saw.

Stop member 41 is provided so that when the log is brought in contact with chain saw blade 22, the log will not be urged forwardly by the movement of the chain saw blade. Guard 42 is provided to avoid accidents as the operator is reaching for additional logs and the like in front of the saw blade.

Thus, the chain saw of the present invention, which is simple in construction, provides a fully automatic way to operate a chain saw while leaving the operator's hands free to handle the logs to be cut.

While the preferred embodiments of the present invention have been described and illustrated, it will be obvious to those skilled in the art that various modifications and changes may be made without departing from the spirit of the present invention. Thus, the scope of the present invention is deemed to be limited only by the appended claims.

The embodiments of the invention in which an exclusive property or privilege is claimed are defined as follows:

1. A chain saw stand comprising:

a stand having a top surface;

means to anchor a chain saw on said top surface with the chain saw blade extending in front of said stand;

a top lever pivotably mounted to said stand above said top surface so as to be adjacent to and generally parallel with said blade and slightly above it;

a throttle lever pivotably mounted on said surface positioned to engage the throttle trigger of said chain saw; and resilient connecting means between the end of said top lever remote from said blade and the end of said throttle lever nearest said trigger whereby when a log is brought in contact with said blade, said log will cause said top lever to pivot downwardly which via said connecting means will cause said throttle lever to pivot upwardly to actuate said trigger to accelerate the engine of said saw for cutting said log and whereby the resilience of said connecting means will permit said top lever to continue pivoting downwardly while said log is moved downwardly during cutting after said throttle lever has completely depressed said trigger and cannot be pivoted upwardly further.

2. A chain saw stand according to claim 1 wherein said anchoring means are clamps.

3. A chain saw stand according to claim 1 wherein said resilient connecting means comprises a heavy-duty rubberband.

4. A chain saw stand according to claim 1 further comprising a log stop positioned so as to be at the end of the blade of a chain saw anchored to said stand.

5. A chain saw stand according to claim 1 further comprising a guard for the end of the blade of a chain saw when anchored to said stand.

* * * * *